United States Patent [19]

Held et al.

[11] Patent Number: 4,516,501

[45] Date of Patent: May 14, 1985

[54] AMMUNITION CONSTRUCTION WITH SELECTION MEANS FOR CONTROLLING FRAGMENTATION SIZE

[75] Inventors: Manfred Held, Aresing; Peter Grössler, Hockstadt, both of Fed. Rep. of Germany

[73] Assignee: Messerschmitt-Bölkow-Blohm GmbH, Fed. Rep. of Germany

[21] Appl. No.: 253,552

[22] Filed: Apr. 13, 1981

[30] Foreign Application Priority Data

May 2, 1980 [DE] Fed. Rep. of Germany ..... 3016861

[51] Int. Cl.[3] ..... F42B 13/18

[52] U.S. Cl. ..... 102/496; 102/389; 102/478; 102/493; 102/275.5

[58] Field of Search ..... 102/323, 477–479, 102/493–497, 389, 275.5

[56] References Cited

U.S. PATENT DOCUMENTS

| | | | |
|---|---|---|---|
| 1,015,944 | 1/1912 | DuPont | 102/497 |
| 3,000,309 | 9/1961 | Zapf | 102/493 |
| 3,298,308 | 1/1967 | Throner, Jr. | 102/496 |
| 3,349,705 | 10/1967 | Wilson | 102/323 X |
| 3,489,088 | 1/1970 | Von Ballmoos et al. | 102/496 |
| 3,491,694 | 1/1970 | Fountain | 102/493 |
| 3,949,674 | 4/1976 | Talley | 102/497 X |
| 3,978,796 | 9/1976 | Hackman | 102/492 |
| 4,004,518 | 1/1977 | Potteiger et al. | 102/492 |

FOREIGN PATENT DOCUMENTS

| | | | |
|---|---|---|---|
| 1142716 | 2/1969 | United Kingdom | 102/493 |
| 2033552 | 5/1980 | United Kingdom | 102/493 |
| 2065839 | 6/1981 | United Kingdom | 102/493 |

*Primary Examiner*—Peter A. Nelson
*Attorney, Agent, or Firm*—McGlew & Tuttle

[57] ABSTRACT

Ammunition, such as a warhead with an explosive charge comprises a casing which is provided with a material construction of a nature providing at least controlled formation of fragments of a certain preferred mass, coverings for formation of explosion formed projectiles of a certain preferred mass, or preformed fragments of a certain preferred mass. The explosive charge is located within the casing and there are means for selective munition conversion alternatively to control formation of fragments or to natural fragmentation. For this purpose one or more recesses are provided in the explosive charge adjacent the casing as a means for munition conversion to the formation of explosion formed projectiles or unshattered preformed fragments. The filling of inert material is provided in at least a portion of the recess and it comprises a liquid inert material or a plastic inert material or a liquid explosive or plastic explosive.

15 Claims, 7 Drawing Figures

AMMUNITION CONSTRUCTION WITH SELECTION MEANS FOR CONTROLLING FRAGMENTATION SIZE

FIELD AND BACKGROUND OF THE INVENTION

The invention relates to an ammunition, such as a warhead with an explosive charge which comprises a casing for controlled formation of fragments of a certain preferred mass, coverings for formation of explosion formed projectiles of a certain preferred mass, or preformed of a certain preferred mass.

From U.S. Pat. No. 3,491,694 an ammunition is known where, upon detonation, a controlled formation of fragments of a certain preferred mass from the explosive charge casing takes place.

A warhead whose explosive charge comprises a casing with projectile forming coverings is known from German Patent DE-AS No. 11 99 162, among others.

Such warheads with an explosive charge casing are used preferably where, at a given charge caliber, natural or preformed fragments are no longer able to provide the necessary penetration. This is the case for example, when armored tanks or similar hard material targets are to be effectively fought with a charge caliber on the order of 100 mm diameter. It is then possible by variation of the covering geometry to impart to the explosion, formed projectile penetration capacities adequate for the respective target object while assuring an additional residual power in the interior of the target. High penetration capacities, however, also require large surface components of the casing, this being reflected in a low number of projectiles.

Often, however, there occur also numerous targets of comparatively small size and/or low resistance. For effectively fighting them, it would be desirable to have available, instead of a small number of large mass fragments or explosion formed projectiles, a larger number of fragments whose penetration capacity may actually be quite low. To take account of this, it would be necessary, as things now stand, to change the warhead types from case to case. But for logistic reasons such a procedure is usually not possible.

SUMMARY OF THE INVENTION

The present invention provides a structurally simple and low-cost ammunition which excels over the known munition types of the same kind by having greater versatility combined with always ensured high effectiveness of fire.

In accordance with the invention, a casing for the ammunition is provided which is made of a material which provides a controlled formation of fragments of a certain preferred mass or it includes covering portions for formation of explosive formed projectiles of a certain preferred mass or, preformed fragments of a certain preferred mass. The explosive charge is located within the casing and the charge is provided with one or more grooves or recesses which are at least partly filled with either an inert material or an explosive material. The construction provides means for the selective munition conversion alternatively to control formation of fragments of another mass or to allow natural fragmentation.

The measures taken according to the invention can be realized without any appreciable additional expense. Their positive result is that with one and the same ammunition design a plurality of target groups differing in frequency, size and hardness, such as soft targets, unarmored vehicles, armored tanks or the like, hard target objects and flying targets, can be fought optimally, and this also if they occur mixed.

Accordingly, it is an object of the invention to provide an ammunition such as a warhead with an explosive charge which comprises a casing providing a material construction of a nature providing at least of: control formation of fragments of certain mass, coverings for formation of explosion formed projectiles with a certain preferred mass, and preformed fragments of certain preferred mass and which further includes an explosive charge in the casing for selective munition conversion alternatively to control formation of fragments of another mass and natural fragmentation.

A further object of the invention is to provide an ammunition which is simple in construction, economical in design and of a durable and practical nature.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 3*b* is an enlarged partial detail of the construction shown in FIG. 3*a.

GENERAL DESCRIPTION OF THE PREFERRED EMBODIMENTS

Figure 1A:
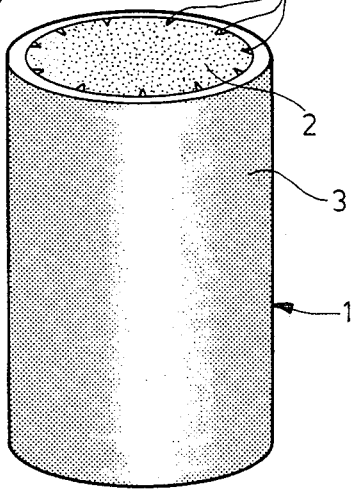
FIG. 1*a* is a front top perspective view of a warhead constructed in accordance with the invention having a natural fragmentation casing.
Figure 1B:
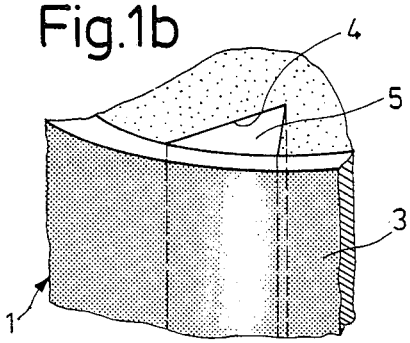
FIG. 1*b* is an enlarged partial perspective view of the warhead shown in FIG. 1*a;*

Referring to the drawings, in particular the invention embodied therein, FIGS. 1*a* and 1*b* comprise a warhead 1 with an explosive charge 2 and a natural fragmentation casing 3. On its outer circumference the explosive charge 2 has, in uniform peripheral distribution, axis-parallel recesses or grooves 4 of e.g. triangular or roof-shaped cross-section. As long as the grooves 4 are air-filled. The grooves 4 act as cutting charges, which, upon an explosive detonation, cause rod type fragments to be formed from the fragmentation casing 3.

For warhead conversion to natural fragmentation it suffices to fill the grooves 4 with inert material or explosive of a liquid or plastic consistency 5.

Figure 2A:
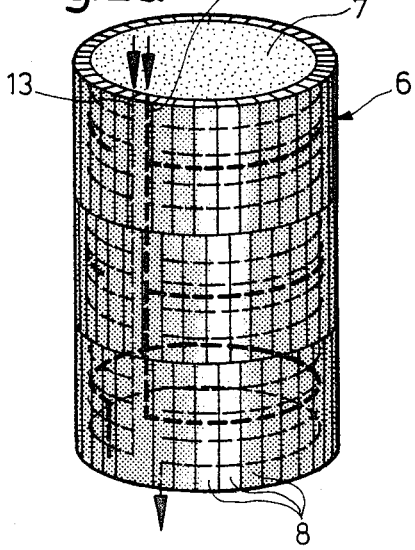
FIG. 2*a* is a view similar to FIG. 1 of another embodiment of the invention.

In FIG. 2*a,* a warhead 6 has been shown whose explosive charge 7 is enveloped for example by rod-shaped fragments 8 in three tiers. The rod-shaped fragments 8 may either be assembled or formed by longitudinal grooves or zonal embrittlement of a shell, e.g. by electron beam welding, in a controlled manner.

Figure 2B:
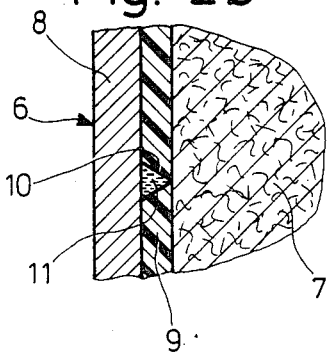
FIG. 2*b* is an enlarged partial sectional view of the warhead shown in FIG. 2*a;*

Between the explosive charge 7 and the rod-shaped fragments 8 is, as FIG. 2*b* illustrates, a layer 9 of plastic or other inert material with grooves 10, the course of which is indicated in broken lines in FIG. 2*a*.

As long as these grooves remain empty, they constitute notches for separating the rod-shaped fragments 8. If the groove volume is filled with inert or reactive substance of a liquid or plastic consistency 11, the originally given size of the rod fragments 8 is preserved in case of detonation of the explosive charge 7. Filling of the grooves 10 can be done through channels 12 and 13. The correlation of the latter to the former is such that only the grooves 10 in the center of the three tiers communicate with channel 12, while all grooves 10 communicate with channel 13. Warhead conversion to three different sizes of preformed fragments is thus possible.

Where a fluid such as liquid is used to fill the grooves, or where selected lengths of cutting cords or detonation fuses are used which embodiments are described later, the selection process for deactivating portions of these mechanisms can be reversed.

Figure 3A:
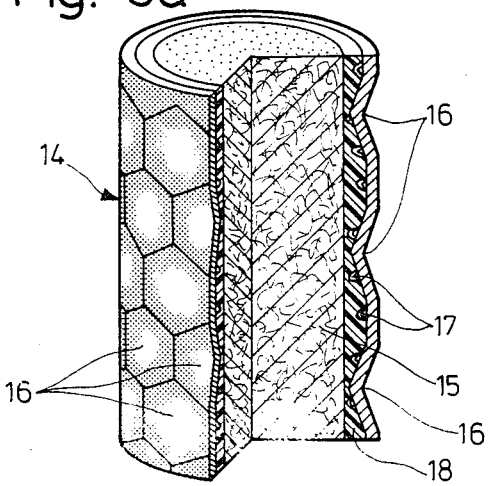
FIG. 3*a* is a front top perspective view of another embodiment of the warhead partly broken away.
Figure 3B:
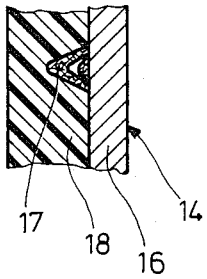
Figure 3C:
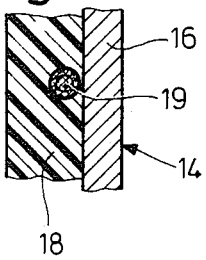
* and FIG. 3*c* is a view similar to FIG. 3*b* of another embodiment of the invention.

FIG. 3*a* shows a warhead 14 having an explosive charge 15, and projectile forming coverings 16. Between the explosive charge 15 and the projectile forming coverings 16, cutting cords or thorns 17 are embedded in a plastic composition 18, for example in the manner appearing from FIG. 3*b*, and this in a distribution shown in FIG. 3*a* over the projectile forming coverings 16. The cutting cords 17 may be replaced by detonation fuses 19 according to FIG. 3*c*. At appropriately small dimensions, the detonation fuses 19 as well as the cutting cords 17 may be embedded directly in the explosive charge 15, doing away with the plastic composition 18.

Normally, in the case of the above described warhead 14, a projectile is formed from such coverings 16 in the case of detonation of its explosive charge 15, the number of projectiles being relatively small if the covering elements are large. If needed, however, disintegration of the covering into several fragments is readily possible. For this it suffices to prime the cutting cords 17 or the detonation fuses 19 shortly before the detonation is introduced into the explosive charge 15, and this leads to the cutting through or at least the notching of the respective contiguous projectile forming covering or coverings 16.

To unify the terminology utilized to describe all of the embodiments disclosed, the grooves or recesses 4 or 10, as well as the cutting cords 17 and detonation fuses 19, are all termed elongated casing dividing means since they all comprise elongated arrangements which extend in a pattern for causing the controlled dividing of the munition casing, whether it be the type previously divided for fragmentation such as those shown in FIGS. 2*a* and 3*a* or the natural undivided type shown in FIG. 1*a*.

The channels 12,13 or mechanisms for selectively detonating the charges 17,19 are termed selection means since they select portions of the elongated casing dividing means to be activated or deactivated for achieving the inventive purpose.

While specific embodiments of the invention have been shown and described in detail to illustrate the application of the principles of the invention, it will be understood that the invention may be embodied otherwise without departing from such principles.

We claim:

1. Ammunition, such as a warhead, comprising:

a casing defining a space;

an explosive charge within said space;

elongated casing dividing means extending in a pattern between said casing and said explosive charge for fragmenting said casing along said casing dividing means with said casing dividing means in an operable condition; and selection means associated with said elongated casing dividing means for placing only selected portions of but not all of, said elongated casing dividing means in an inoperable condition to change the size for fragments of the casing to be formed upon explosion of the explosive charge and operation of a remaining operable portion of said elongated casing dividing means.

2. Ammunition according to claim 1, wherein said elongated casing dividing means compresses a plurality of grooves extending in said explosive charge adjacent said casing, said selection means comprising a filling in some of said grooves.

3. Ammunition according to claim 2, wherein said filling is chosen from the group consisting of liquid inert material, plastic inert material, liquid explosive material and plastic explosive material.

4. Ammunition according to claim 2, wherein said explosive charge includes a covering layer, said grooves defined in said covering layer.

5. Ammunition according to claim 2, wherein said casing comprises a plurality of interfitting casing portions surrounding said explosive charge and forming fragments of said casing upon explosion of said explosive charge, said grooves extending transversely to said casing portions for further fragmenting said casing portions upon explosion of said explosive charge when said grooves are empty of filling material.

6. Ammunition according to claim 5, wherein said casing is cylindrical, said casing portions extending axially of said casing and said grooves extending circumferentially of said casing and said explosive charge.

7. Ammunition according to claim 6, wherein said circumferentially extending grooves are spaced axially along said casing, said selection means comprising a first conduit interconnecting all of said grooves and a second conduit interconnecting selected ones of said grooves only, whereby a selected number and all of said grooves can be filled with filling material for regulating the number of fragments produced of said casing and casing portions upon explosion of said explosive charge.

8. Ammunition according to claim 1, wherein said elongated casing dividing means comprises elongated detonation cord extending adjacent said casing and in said explosive charge, said selection means comprising means for detonating at least a portion of said cord at an earlier time than a detonation of said explosive charge.

9. Ammunition according to claim 8, wherein said casing comprises a plurality of casing portions interconnected and surrounding said explosive charge, said casing portions forming fragments upon explosion of said explosive charge, said cord extending across said casing portions to further divide said portions into fragments upon earlier detonation of said cord by said selection means.

10. Ammunition according to claim 9, wherein said explosive charge includes a lining of non-explosive material adjacent said casing in which said cord is embedded.

11. A method of controlling the fragmentation of ammunition having a casing for defining a space and filled with explosive charge, comprising:

providing elongated casing dividing means between said casing and said explosive charge which is operable upon detonation of said explosive charge to divide said casing into fragments; and selectively deactivating only portions of but not all of said elongated casing dividing means for changing the pattern of fragmentation of said casing upon detonation of said explosive charge.

12. A method according to claim 11, wherein said elongated casing dividing means comprises elongated grooves, said elongated grooves being selectively filled with one of a liquid and plastic material to deactivate a filled portion of said groove.

13. A method according to claim 11, wherein said elongated casing dividing means comprises detonatable cord, selected sections of said cord being detonated earlier than a detonation of said explosive charge for regulating a pattern of fragments formed by said casing.

14. Ammunition according to claim 1, wherein said selection means are reversible for rendering operable selected portions of said elongated casing dividing means which were previously placed in an inoperable condition by said selection means.

15. A method according to claim 11 including reactivating parts of the selectively deactivated portions of the elongated casing dividing means for again changing the pattern of fragmentation of the casing upon detonation of said explosive charge.

* * * * *